United States Patent [19]

Bähler

[11] 4,265,840

[45] May 5, 1981

[54] VAPOR DISTRIBUTOR PIPE FOR AIR HUMIDIFIER

[76] Inventor: Paul Bähler, Wangenstrasse 8, Dübendorf, Switzerland

[21] Appl. No.: 76,538

[22] Filed: Sep. 18, 1979

[30] Foreign Application Priority Data

Sep. 25, 1978 [CH] Switzerland ..... 9958/78

[51] Int. Cl.[3] ..... B01F 3/04

[52] U.S. Cl. ..... 261/115; 239/553; 239/566; 261/118; 261/159

[58] Field of Search ..... 261/115, 118, 152, 155, 261/158–161, DIG. 77; 239/553, 566

[56] References Cited

U.S. PATENT DOCUMENTS

| | | | |
|---|---|---|---|
| 1,985,010 | 12/1934 | Berkhuijsen | 261/115 |
| 2,077,554 | 4/1937 | Fleisher | 261/161 |
| 2,872,297 | 2/1959 | Dugan | 261/115 X |
| 3,031,174 | 4/1962 | Swanton | 261/161 X |
| 3,096,817 | 7/1963 | McKenna | 261/115 X |
| 3,386,659 | 6/1968 | Rea | 261/118 X |
| 3,486,697 | 12/1969 | Fraser | 261/115 X |
| 4,130,611 | 12/1978 | Brand | 261/115 X |

FOREIGN PATENT DOCUMENTS

| | | | |
|---|---|---|---|
| 5125 | of 1908 | United Kingdom | 261/155 |

*Primary Examiner*—Richard L. Chiesa
*Attorney, Agent, or Firm*—Ladas & Parry

[57] ABSTRACT

A vapor-air humidifier for air climatizing or conditioning installations is disclosed which comprises a double-wall vapor distributor pipe defining vapor exhaust pipe means. By means of a jacket chamber or space, heated by the vapor or steam, the internal space or chamber of the vapor-air humidifier remains free of condensate due to cooling of the air current. The vapor transfered to the air current is thus removed from the internal space which is free of condensate and there is prevented any spraying of water of condensation. Since vapor exhaust elements are arranged along the exhaust pipe means and are distributed over the entire channel cross-section of the humidifier, there is avoided the formation of vapor layers.

8 Claims, 2 Drawing Figures

VAPOR DISTRIBUTOR PIPE FOR AIR HUMIDIFIER

BACKGROUND OF THE INVENTION

The present invention relates to a new and improved construction of vapour-air humidifier and, more specifically, concerns itself with a novel vapour or steam distributor pipe for vapour-air humidifiers of air climatizing or conditioning installations.

One of the major drawbacks of the heretofore known vapour-air humidifiers used in air climatizing installations is that they tend to spray, together with the ejection of the vapour or steam, the water of condensation which has deposited upon the inner surface of the vapour distributor pipe due to cooling of the air flow which is to be humidified or moisturized. Additionally, the distribution of vapour or steam at the air flow which is to be humidified is irregular. This can lead, on the one hand, to localized over-saturation or the formation of vapour clouds, and thus, to a long humidifying path, and, on the other hand, can cause the deposition of condensate at parts located along the flow path. Consequently, the regions surrounding the air climatizing installation and located in the direction of air flow can become wet which, on the one hand, can result in corrosion of such wet parts, and, on the other hand, can promote the formation of bacteria colonies or cultures.

SUMMARY OF THE INVENTION

Therefore, with the foregoing in mind, it is a primary object of the present invention to provide a new and improved construction of vapour distributor pipe for an air humidifier which is not afflicted with the aforementioned drawbacks and shortcomings of the prior art proposals.

Another and more specific object of the present invention aims at providing an air humidifier which is equipped with a vapour or steam distributor pipe structured so as to prevent spraying of the water of condensation upon exhaust of the vapour or steam out of the vapour distributor pipe and, furthermore, affording a relatively uniform distribution of the ejected vapour at the air flow which is to be moisturized or himidified.

Still a further significant object of the present invention aims at the provision of a new and improved construction of vapour distributor pipe for an air humidifier which is relatively simple in design, economical to manufacture, reliable in operation, and allows for uniform distribution of the vapour at the air flow which is to be humidified, while at least minimizing the spraying of condensate water during the exhaust of the vapour or steam into the air flow.

Now in order to implement these and still further objects of the invention, which will become more readily apparent as the description proceeds, the vapour distributor pipe of the present development is manifested by the features that the inlet openings for the vapour of the exhaust or outlet elements are arranged in the internal space of the vapour distributor pipe and may optionally extend from the region of an inner wall bounding said internal space towards the central axis of the exhaust pipe means; and that, furthermore, the vapour exhaust pipe means is a double-wall structure. The inlet openings of the vapour exhaust elements may be located adjacent the inner wall bounding the internal chamber or space of the vapour distributor pipe. Due to the insulation action of the outer chamber or space of the vapour distributor pipe surrounding the internal chamber or space, the vapour is removed from such inner or internal space which is free or essentially free of condensate, and thus, there is beneficially avoided any spraying of water of condensation during vapour exhaust out of the vapour distributor pipe. An essentially uniform vapour distribution is obtained in that, a number of vapour distributor pipes may be arranged vertically until almost horizontally at the air current or flow which is to be moisturized, and that the exhaust elements are distributively arranged at different locations throughout the length of the exhaust pipe means. All of the exhaust elements expel the same quantity of vapour or steam per unit of time by virtue of the excess pressure which is uniformly distributed and prevails within the pipe system. Consequently, there is avoided any localized over-saturation or the formation of vapour layers and vapour clouds and the path needed for humidifying the air is correspondingly shorter.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
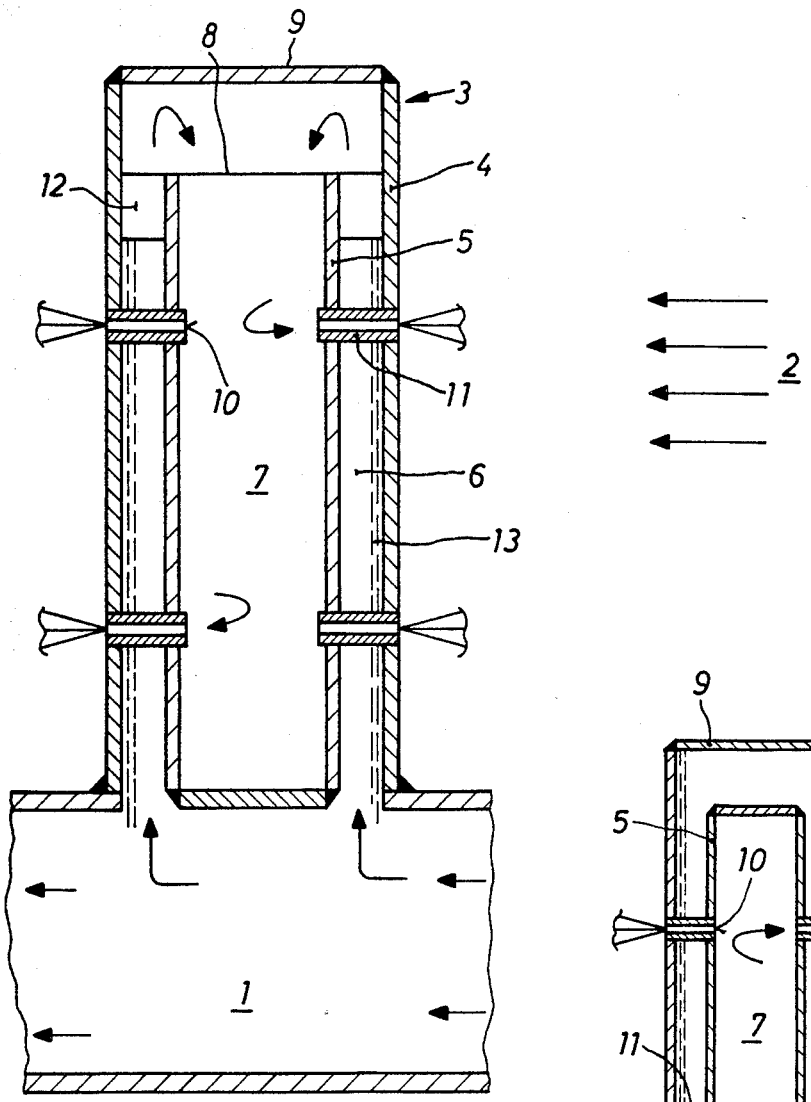
FIG. 1 is a fragmentary sectional view of a first exemplary embodiment of air humidifier having a collector and equipped with a vapour distributor pipe structured according to the invention.

Describing now the drawings, it is to be understood that only enough of the construction of the air humidifier has been shown in order to enable those skilled in the art to readily understand the underlying principles of the present invention which are predominantly concerned with the novel construction of vapour or steam distributor pipe, hereinafater generally simply referred to as vapour distributor pipe or pipe means. By referring to the exemplary embodiment of FIG. 1, there will be seen only part of an air humidifier containing a collector 1 at which there is secured in any appropriate fashion a vapour distributor pipe or pipe system 3, constituting a vapour exhaust or ejection pipe means. The vapour distributor pipe system 3 is shown to be arranged essentially vertically with respect to the collector 1, but can also be positioned to be almost horizontal. Hence, vapour distributor pipe system 3 is to be conceptually considered as extending at any desired location between the vertical and an almost horizontal position. This vapour distributor pipe or pipe system 3 will be seen to encompass two axially arranged pipes or tubes 4 and 5 which divide the vapour distributor pipe 3 into an outer chamber or space 6 and an inner chamber or space 7. The inner or internal space or chamber 7 can flow communicate for instance with the outer chamber or space 6 in that, the open end 8 of the inner pipe 5 is arranged to terminate in spaced relationship from the closed end 9 of the outer pipe 4 which bounds the outer chamber 6. Inlet openings 10 of vapour exhaust or outlet elements 11 are distributively arranged over the length of the exhaust pipe means, i.e. the double-wall pipe system 3 and are disposed in the inner chamber or space 7 and extend to the region of the wall of the outer pipe or tube 4. A droplet separator 12, arranged in the outer chamber or space 6 forwardly of the point of entry of vapour into the inner chamber or space 7, prevents that water of condensation 13 which has deposited at the inner surface or wall of the outer pipe or tube 4 can reach the inner space or chamber 7. The water of condensation 13 which has deposited at the inner surface of the outer pipe or tube 4, due to the action of the cold air flow or current 2, flows into the collector 1 where it is collected. The vapour or steam infeed to the exhaust elements 11 is accomplished from the collector 1, through the outer chamber or space 6, via the droplet separator 12, to the inlet openings 10 of the exhaust elements 11 in the inner space or chamber 7.

Figure 2:
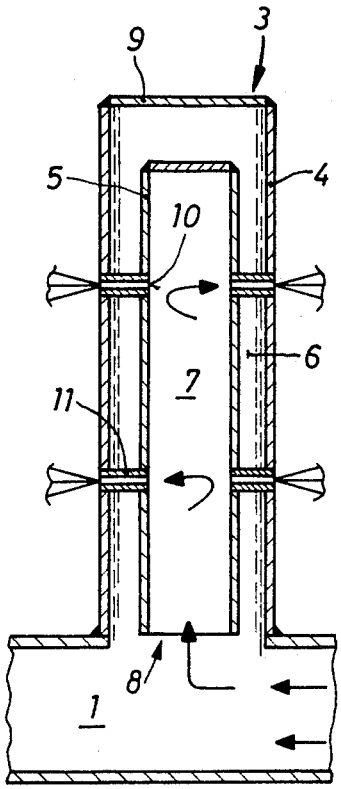
FIG. 2 is a view, similar to the showing of FIG. 1, of a modified construction.

Continuing, it is here mentioned that the vapour distributor tube 3 which has been shown vertically arranged in the arrangement of FIG. 1, as mentioned, can be employed having an almost horizontal or inclined position. The vapour infeed to the inlet openings 10 of the exhaust elements 11 in the inner chamber or space 7 can also be accomplished in a manner, opposite to the showing of FIG. 1, and as illustrated in FIG. 2 directly from the collector or collector means 1. In this case, the outer stationary vapour chamber or space 6 only functions as an insulation and as the heating jacket or shell for the inner space or chamber 7.

While there are shown and described present preferred embodiments of the invention, it is to be distinctly understood that the invention is not limited thereto, but may be otherwise variously embodied and practiced within the scope of the various claims.

What I claim is:

1. A vapour distributor pipe arrangement for an air humidifier, comprising vapour exhaust pipe means formed by an inner wall, which bounds an inner chamber of the vapour exhaust pipe means, and an outer wall, which surrounds said inner wall and defines therewith an outer chamber of the vapour exhaust pipe means, said outer chamber being in communication with said inner chamber, and said arrangement further comprising a plurality of vapour exhaust elements, each of which is mounted in the inner and outer walls of the vapour exhaust pipe means so that it extends from the inner chamber to the exterior of the vapour exhaust pipe means through the outer chamber, whereby vapour which enters the inner chamber can pass to the exterior of the vapour exhaust pipe means through said vapour exhaust elements.

2. The vapour distributor pipe arrangement as defined in claim 1, wherein said inner wall and said outer wall are formed by inner and outer pipes respectively.

3. The vapour distributor pipe arrangement as defined in claim 2, wherein said inner pipe has an inner peripheral surface and defines a longitudinal axis, and wherein each vapour exhaust element has an inlet opening which is located between said inner peripheral surface and said longitudinal axis.

4. The vapour distributor pipe arrangement as defined in claim 2, wherein said inner and outer pipes are substantially coaxially arranged and each is closed at one end thereof, said vapour exhaust elements being distributed over the length of the vapour exhaust pipe means.

5. The vapour distributor pipe arrangement as defined in claim 1, further including:

collector means for infeeding vapour to said inner chamber.

6. The vapour distributor pipe arrangement as defined in claim 5, wherein:

said collector means feeds vapour directly to said inner chamber.

7. The vapour distributor pipe arrangement as defined in claim 5, wherein:

said collector means feeds vapour to said inner chamber by means of said outer chamber.

8. The vapour distributor pipe arrangement as defined in claim 1, wherein:

said vapour distributor pipe means is arranged at a random position with respect to an air flow which is to be humidified.

* * * * *